US011337471B2

(12) United States Patent
Schwirtz et al.

(10) Patent No.: US 11,337,471 B2
(45) Date of Patent: May 24, 2022

(54) GARMENT

(71) Applicant: adidas AG, Herzogenaurach (DE)

(72) Inventors: Peter Andreas Schwirtz, Herzogenaurach (DE); Conroy James Nachtigall, Herzogenaurach (DE)

(73) Assignee: ADIDAS AG, Herzogenaurach (DE)

( * ) Notice: Subject to any disclaimer, the term of this patent is extended or adjusted under 35 U.S.C. 154(b) by 104 days.

(21) Appl. No.: 16/014,239

(22) Filed: Jun. 21, 2018

(65) Prior Publication Data

US 2018/0368497 A1 Dec. 27, 2018

(30) Foreign Application Priority Data

Jun. 23, 2017 (DE) ..... 10 2017 210 667.0

(51) Int. Cl.
*A41D 15/04* (2006.01)
*A41D 27/20* (2006.01)
*A41D 3/04* (2006.01)

(52) U.S. Cl.
CPC ..... *A41D 15/04* (2013.01); *A41D 3/04* (2013.01); *A41D 27/20* (2013.01); *A41D 2400/422* (2013.01)

(58) Field of Classification Search
CPC . A41D 15/04; A41D 3/04; A41D 3/00; A41D 15/00; A41D 1/02; A41D 27/20; A41D 2400/422; A41D 2400/42; A45F 4/12; A45F 4/02
USPC ..... 2/93, 94, 108, 253, 85
See application file for complete search history.

(56) References Cited

U.S. PATENT DOCUMENTS

| | | | | |
|---|---|---|---|---|
| 254,636 A | | 3/1882 | Gothberg | |
| 2,143,931 A | | 1/1939 | Aronson | |
| 2,292,347 A | * | 8/1942 | Bailey | A41D 15/00 2/93 |
| 3,670,340 A | | 6/1972 | Walker | |
| 4,067,066 A | * | 1/1978 | Bruno | A41D 15/04 2/105 |
| 4,149,272 A | * | 4/1979 | Maeshima | A41D 3/00 2/102 |
| 4,404,687 A | * | 9/1983 | Hager | A41D 3/005 2/94 |
| 4,502,154 A | | 3/1985 | Itoi | |
| 4,689,831 A | | 9/1987 | Greenberger et al. | |
| 4,891,846 A | * | 1/1990 | Sager | A41D 13/1245 128/874 |

(Continued)

FOREIGN PATENT DOCUMENTS

| | | | | |
|---|---|---|---|---|
| CA | 3022005 A1 | * | 8/2018 | A41D 15/04 |
| CN | 205728127 | | 11/2016 | |

(Continued)

OTHER PUBLICATIONS

Office Action, German Patent Application No. 102017210667.0, dated Apr. 3, 2018, 9 pages.

(Continued)

*Primary Examiner* — Jameson D Collier
(74) *Attorney, Agent, or Firm* — Kilpatrick Townsend & Stockton LLP

(57) ABSTRACT

Described is a garment (10) having an integrated first pocket (55) into which the garment (10) may be packed, when not in use and wherein the first pocket (55) has an opening (180) arranged at the lower end of the garment (10).

18 Claims, 7 Drawing Sheets

(56) References Cited

U.S. PATENT DOCUMENTS

| | | | | | |
|---|---|---|---|---|---|
| 5,483,701 | A * | 1/1996 | Ferreyros | A41B 13/103 | 2/247 |
| 5,787,504 | A | 8/1998 | Wu | | |
| 5,850,634 | A | 12/1998 | Toombs | | |
| 5,860,164 | A * | 1/1999 | Johnson | A41D 15/04 | 2/108 |
| 6,141,798 | A * | 11/2000 | Manning | A41B 13/103 | 2/46 |
| 6,332,222 | B1 | 12/2001 | Graham | | |
| 6,385,775 | B1 * | 5/2002 | Komjati | A41D 15/04 | 2/86 |
| 6,405,377 | B1 * | 6/2002 | Davis | A41D 15/04 | 2/108 |
| 6,532,596 | B1 * | 3/2003 | Fosmo | A42B 1/045 | 2/49.1 |
| 6,564,388 | B1 * | 5/2003 | Poston | A41D 15/04 | 2/84 |
| 8,032,948 | B2 | 10/2011 | Anderson | | |
| 2006/0059597 | A1 * | 3/2006 | LaRocco | A41B 13/103 | 2/49.1 |
| 2006/0150297 | A1 | 7/2006 | Turner | | |
| 2008/0078027 | A1 * | 4/2008 | Smith | A41D 15/04 | 5/413 R |
| 2008/0115251 | A1 * | 5/2008 | Puckey | A45F 4/12 | 2/69.5 |
| 2008/0209612 | A1 * | 9/2008 | Summers | A41D 3/08 | 2/84 |
| 2010/0111448 | A1 * | 5/2010 | Li | A41D 15/04 | 383/4 |
| 2013/0067631 | A1 * | 3/2013 | Crye | A41D 3/00 | 2/85 |
| 2014/0259299 | A1 * | 9/2014 | Sievwright | A41D 27/20 | 2/252 |
| 2015/0096097 | A1 | 4/2015 | Soon-osberger | | |

FOREIGN PATENT DOCUMENTS

| | | | | |
|---|---|---|---|---|
| EP | 3417729 | A1 * | 12/2018 | A41D 3/04 |
| JP | U 3160080 | | 5/2010 | |
| JP | 6055145 | | 12/2016 | |
| TW | M447097 | | 2/2013 | |
| WO | 9602163 | | 2/1996 | |
| WO | WO-2014182733 | A1 * | 11/2014 | A41D 3/005 |

OTHER PUBLICATIONS

European Patent Application No. 18178927.2, European Search Report dated Oct. 12, 2018, 6 pages.

Chinese Application No. 201810652637, Office Action dated Nov. 29, 2019, 17 pages (8 pages of translation and 9 pages of Original document).

Japanese Application No. 2018118521, Office Action dated Sep. 24, 2019, 6 pages (3 pages of English Translation and 3 pages of Original document).

European Patent Application No. 18178927.2, Office Action dated Apr. 17, 2020, 4 pages.

European Patent Application No. 18178927.2, Office Action dated Jul. 26, 2019, 5 pages.

Japanese Patent Application No. 2018-118521, Office Action dated Apr. 28, 2020, 6 pages (English machine translation provided).

Chinese Patent Application No. 201810652637.7, Office Action dated Aug. 21, 2020, 20 pages (English machine translation provided).

German Patent Application No. 102017210667.0, Office Action, dated May 18, 2021, 12 pages (English machine translation provided).

Office Action, Chinese Patent Application No. 201810652637.7, dated Dec. 30, 2020, 18 pages.

Chinese Application No. 201810652637.7, Office Action dated Jul. 23, 2021, 6 pages (English machine translation submitted).

* cited by examiner

GARMENT

CROSS REFERENCE TO RELATED APPLICATION

This application is related to and claims priority benefits from German Patent Application No. DE 102017210667.0, filed on Jun. 23, 2018, entitled Garment ("the '667 application"). The '667 application is hereby incorporated herein in its entirety by this reference.

FIELD OF THE INVENTION

The present invention relates to a garment that may be packed into an integrated pocket for conveniently storing and carrying the garment when not in use.

BACKGROUND

Changing environmental conditions and/or activity levels of a person wearing a garment may result in the desire to remove the garment from the person's body. The need to carry the garment by the person may be inconvenient in absence of carrying means especially during outdoor and sports activities. In this context, foldable garments with integrated bags for carrying the garment are well known in the prior art, for example in the U.S. Pat. No. 2,143,931, the U.S. Pat. No. 254,636, the U.S. Pat. No. 4,502,154, the US 2006/0150297 A1, the U.S. Pat. No. 8,032,948, the U.S. Pat. No. 5,850,634 A, the US 2015/0096097 A1, the U.S. Pat. No. 4,689,831 A, the U.S. Pat. No. 5,787,504 A and the U.S. Pat. No. 3,670,340.

However, the garments disclosed in the prior art have various disadvantages. For example, the integrated bags are in some cases arranged such that moisture, dirt and insects may easily enter the bag when the garment is used so that additional closure means are needed (zippers or buttons). The closure means in turn may be uncomfortable for the wearer when the garment is in use. Additionally, the closure means are costly to manufacture and may fail after a short amount of time, as it is for example known for thin zippers.

Another disadvantage of the foldable garments of the prior art is that the integrated bags are typically very small, which requires a dense stuffing of the garment into the bag, when the garment is not in use. The tight folds of the densely stuffed garment inside the bag can easily damage sensitive materials such as water-tight and breathable membranes of the garment.

Finally, manufacturing such an integrated bag as part of a garment of the above mentioned prior art typically involve intricate and thereby time-consuming manufacturing steps such as providing additional seams at positions of the garment which are difficult to reach during manufacture.

The present invention is therefore based on the problem to further improve such a foldable garment in order to at least partly overcome at least one of the above-mentioned disadvantages of the prior art.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

In some aspects, the present invention is directed to a garment comprising: a. an integrated first pocket into which the garment is packed, when not in use; b. wherein the first pocket comprises an opening arranged at the lower end of the garment. The opening may be downwardly directed. In some aspects, the opening does not comprise a closure means. In some aspects, the first pocket may extend along a majority of the vertical extension of a back panel of the garment. The first pocket comprises a ply of material sharing a seam with a seam interconnecting at least two panels of the garment. The first pocket may comprise a second pocket into which the first pocket is packed, when the garment is packed into the first pocket. The second pocket may be arranged inside the first pocket when the garment is in use. The first pocket may further comprise a pulling element adapted to cause a downward pull of the garment into the first pocket. The pulling element may comprise a first fixing element adapted to interact with a second fixing element attached to the first pocket thereby forming a carrying strap for the first pocket. The garment may be packed into the first pocket by everting the first pocket and/or the garment. In some aspects, the garment is an upper body garment.

BRIEF DESCRIPTION OF THE DRAWINGS

In the following detailed description, embodiments of the invention are described referring to the following figures.

BRIEF DESCRIPTION

Figure 1:
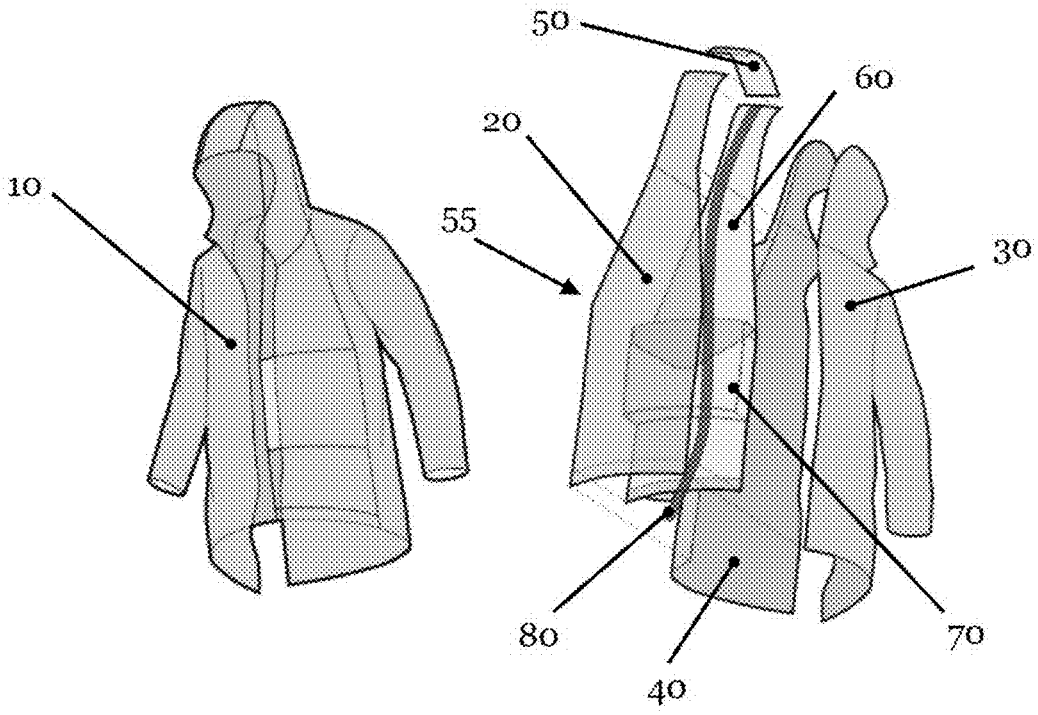
FIG. 1: a front view and an exploded view of a rain protection parka according to embodiments of the present invention.

The above mentioned problem is at least partly solved by the subject matters of the independent claims of the present application. In one embodiment, the present invention provides a garment comprising an integrated first pocket into which the garment may be packed, when not in use, wherein the first pocket comprises an opening arranged at the lower end of the garment.

For example, if the garment is a garment for rain protection, these embodiments ensure that no significant amount of moisture and/or dirt enters through the opening and accumulates inside the first pocket. Therefore, the garment does not need to comprise a dedicated means for closing the opening of the pocket in order to keep the pocket dry and clean. This aspect reduces manufacturing cost and complexity and eliminates the possibility of failure of the closure means.

In further embodiments of the invention, the opening of the first pocket is downwardly directed thereby further reducing the risk that moisture and/or dirt enters the pocket. Additionally, this arrangement facilitates the removal of moisture and/or dirt from the pocket while the garment—a rain coat for example—is in use or hung to a coat hook or hat rack. Moreover, an opening that is arranged at the lower end of the garment and is downwardly directed may be completely concealed while the garment is in use thereby improving appearance and wearing comfort.

In further embodiments of the invention, the first pocket is arranged such that it extends along a majority of the vertical extension of a back panel of the garment. This arrangement facilitates a less dense package of the garment when not in use, wherein the garment may be folded along only a few folding lines extending along the back panel of the garment. If the outer material of the garment comprises sensitive materials such as water-tight and/or breathable membranes, such a folding pattern may significantly reduce the stress on the membranes by packing the garment. Additionally, moisture that may still cover the outer surface of the garment when it is packed inside the pocket can thereby be easily drained and removed from the pocket.

In further embodiments of the invention, the pocket comprises a ply of material sharing a seam with a seam interconnecting at least two panels of the garment.

This arrangement facilitates manufacturing of the pocket by reducing the need for additional seams. If the garment comprises for example a back panel that is connected with a left front panel, a right front panel and a head piece via seams, the pocket may be formed on the inside of the back panel by a single additional ply of material that shares all seams with the seams connecting the back panel to the other panels.

In further embodiments of the invention, the first pocket comprises a pulling element adapted to cause a downward pull on the garment into the first pocket. By pulling on the pulling element, the garment is easily pulled into the first pocket, which may be simultaneously everted, thereby eliminating the need for a complicated and time-consuming folding procedure. For example, this feature may be of importance for a professional athlete competing in a competition and being subjected to changing weather conditions.

The pulling element may comprise a first fixing element adapted to interact with a second fixing element attached to the first pocket thereby forming a carrying strap for the first pocket. Thus, the pulling element may also be used to carry the packed garment, for example by carrying it across the upper torso, so that both arms and hands are free for other activities but the garment is still available for immediate reuse.

In further embodiments of the invention, the first integrated pocket comprises a second pocket into which the first pocket may be packed, when the garment is packed into the first pocket. This arrangement allows for two distinct packaging configurations of the garment. For example, if the second pocket is much smaller than the first pocket, the garment may be packed into the first pocket if a higher package volume is acceptable and desired in order to reduce the stress on the garment material, as noted above. When a smaller package volume is desired—for example if the garment needs to be stored inside the limited remaining volume of an already loaded hiking backpack or any other storage device—the package volume can easily be further decreased by packing the first pocket into the second.

In further embodiments of the invention, the second pocket is arranged inside the first pocket when the garment is in use. If for example, the first pocket is formed between the back panel of a garment and an additional ply of material that is attached to the inner surface of the back panel, the second pocket is completely concealed within the first pocket and neither degrades the appearance nor the wearing comfort of the garment, when the garment is in use. Additionally, the second pocket is thereby protected against physical damage inside the first pocket.

In further embodiments of the invention, the garment comprises an upper body garment such as a heavy duty rain coat, a winter parka or similar.

In further embodiments of the invention, the above presented teachings are applied to a bag, comprising an integrated first pocket into which the bag may be packed, when not in use, wherein the first pocket comprises a second pocket into which the first pocket may be packed, when the bag is packed into the first pocket. As for the garment, this arrangement allows for two distinct packaging configurations of the bag. For example, if the second pocket is much smaller than the first pocket, the bag may be packed into the first pocket if a higher package volume is acceptable and desired in order to reduce the stress on the bag material. When a smaller package volume is desired—for example if the bag needs to be stored inside the limited remaining volume of an already loaded hiking backpack or any other storage device—the package volume can easily be further decreased by packing the first pocket into the second.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following, exemplary embodiments of the present invention of a garment that may be packed into an integrated pocket are described in more detail with reference to an upper body garment, such as a rain protection parka. However, it is to be understood that the present invention is not limited to such specific embodiments but could be applied to other types of garments, for instance trousers, coats or jackets etc. as well.

Moreover, while specific feature combinations are described in the following with respect to certain embodiments of the present invention, it is to be understood that the disclosure is not limited to such embodiments. In other words, not all features have to be present for realizing the invention and the embodiments may be modified by combining certain features of one embodiments with at least one feature of another embodiment.

FIG. 1 shows a rain protection parka 10 according to embodiments of the present invention. The left part of FIG. 1 depicts a front view of the parka 10. The right part of FIG. 1. depicts an exploded view of the parka 10. The parka 10 comprises a back panel 20, a right front panel 30 comprising a sleeve and a part of a hood, a left front panel 40 also comprising a sleeve and a part of a hood, a head panel 50, an inner lining ply 60, a first pocket 55 (also see FIG. 4 below), that is formed between the back panel 20 and the inner lining ply 60, a second pocket 70 and a pulling element 80. Other embodiments of the invention may comprise a different number of panels which may be of different shape and material as for the presented embodiments.

The inner lining ply 60 may comprise the same or a different material than the panels 20, 30, 40, 50 of the parka. The panels 20, 30, 40, 50 in turn may also comprise the same or different materials. The cut lines of the explosion view illustrate the seams where the panels 20, 30, 40, 50 of the parka 10 are joined together. The seams may be provided by sewing, gluing, or welding, etc. The inner lining ply 60 may have the same circumferential dimensions as the back panel 20. Thus, it may be connected to the back panel 20 by the same seams, which are used to connect the other panels 30, 40, 50 of the parka 10 to the back panel 20. Such an arrangement facilitates the manufacture of the parka 10, since a reduced number or even no additional seams are needed to provide the first pocket 55 at the back panel 20

In this way, an elongated first pocket 55 is formed between the back panel 20 and the inner lining ply 60. The first pocket 55 comprises an opening at the lower end of the parka 10. The rim of the opening is formed by the lower edge of the back panel 20 and the lower edge of the inner lining ply 60. The first pocket 55 may extend along the complete or at least the majority of the vertical extension of the back panel 20 and may extend along a part or the complete horizontal extension of the back panel 20.

A pulling element 80 is arranged inside the first pocket 55 and may be connected to the upper seam that joins back panel 20, the head piece 50 and inner lining ply 60. In others embodiments, there may be other attachment points. The pulling element 80 may extend along a part or the full vertical extension of the first pocket 55 to be easily accessed by hand through the opening located at the lower end of the parka 10. A second pocket 70, which may or may not comprise a different material than the other elements of the parka 10 is arranged inside the first pocket 55 and is attached to a surface of the inner lining ply 60. The second pocket 70 may also be attached to the back panel 20 or even be attached to the outer surface of the inner lining ply 60. The dimensions, shape and exact position of the second pocket 70 inside the first pocket 55 may differ for various embodiments of the invention.

Figure 2:
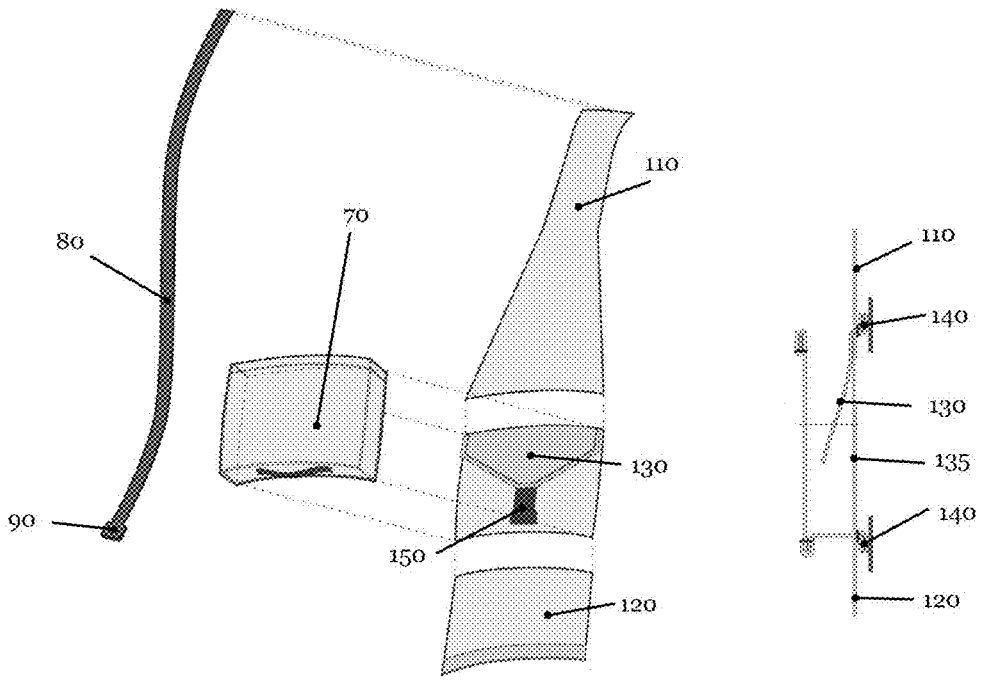
FIG. 2: an exploded view of a sub-assembly of the first pocket and a cross-sectional view of the second pocket according to embodiments of the present invention.

FIG. 2 depicts a sub-assembly of a rain protection parka 10 according to embodiments of the present invention. The right part of FIG. 2 depicts an explosion-view of some of the elements forming the elongated first pocked 55. As may be seen, the inner lining ply 60 may comprise an upper part 110 and a lower part 120 that are connected with the upper and lower edge of a surface of the second pocket 70. In other embodiments of the invention the inner lining ply 60 may comprise a different number of parts comprising different materials. Also, the second pocket 70 may be a fully separate element that is not integrated but only attached to the inner lining ply 60 or any other element of the parka 10.

The pulling element 80 is connected to the upper edge of the upper part 110 of the inner lining ply 60 and may comprise a fixing element 90 as is known in the art such as, a part of a buckle, a hook, a carabiner, etc. The second pocket 70 may comprise a lid 130 and a buckle or any other fixing element 150 to close the second pocket 70.

The right part of FIG. 2 depicts a cross-sectional view of the inner lining ply 60 and the second pocket 70 when the upper part 110 of the inner lining ply 60, the back side 135 of the second pocket 70 and the lower part 120 of the inner lining ply 60 are connected to each other by stitching seams 140. The second pocket 70 may be attached to the inner lining ply 60 and be arranged in an inside-out configuration, such that it may be everted when the parka 10 is packed into it.

Figure 3:
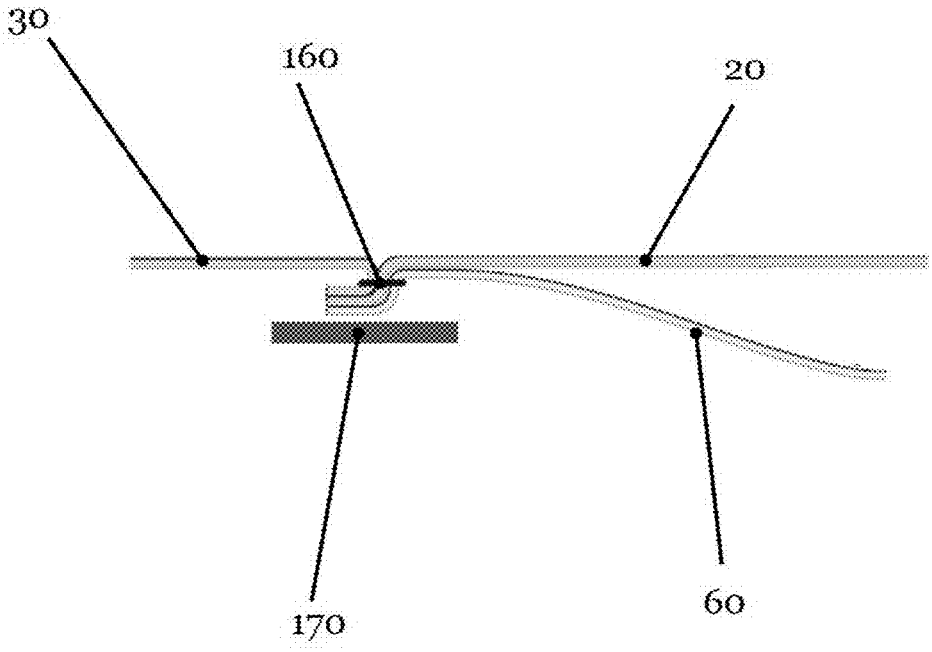
FIG. 3: a cross-sectional view detailing the connecting seam between a back panel and a side panel of the parka and an additional ply of material used to form the first pocket according to embodiments of the present invention.

FIG. 3 depicts a cross-sectional view of one of the connection seams 160 and the adjacent parts of the parka 10 according to embodiments of the present invention. The back panel 20 is connected to the right front panel 30 and the inner lining ply 60 via a single stitching seam 160 that may be reinforced by a strip of material 170 comprising, for example, a flexible and waterproof material such as PACLITE™. In other embodiments of the invention the connection seams between the elements of a garment may also be connected by different means like welding, gluing or even zippers, etc.

In this example the back panel 20, the right front panel 30 and the inner lining ply 60 may be connected during a single manufacturing step, thereby reducing the number of total manufacturing steps for producing the parka 10 with integrated pocket. For the embodiments depicted in FIG. 1 the connection method illustrated in FIG. 3 is employed for all edges that form the first pocket 55, thereby requiring no additional manufacturing steps for integrating the first pocket 55 into the parka 10.

For some embodiments of the present invention the two plies of material that form the first pocket 55 may comprise the same material that may be waterproof and/or breathable. In this case the parka 10 would be waterproof when in use and when stored inside the first pocket 55. The inner lining ply 60 may also comprise a more light and flexible material as the outer panels 20, 30, 40, 50 of the parka 10 thereby potentially reducing the weight of the parka 10 and facilitating a fast and simple folding process of the parka 10 into the first pocket 55.

Figure 4:
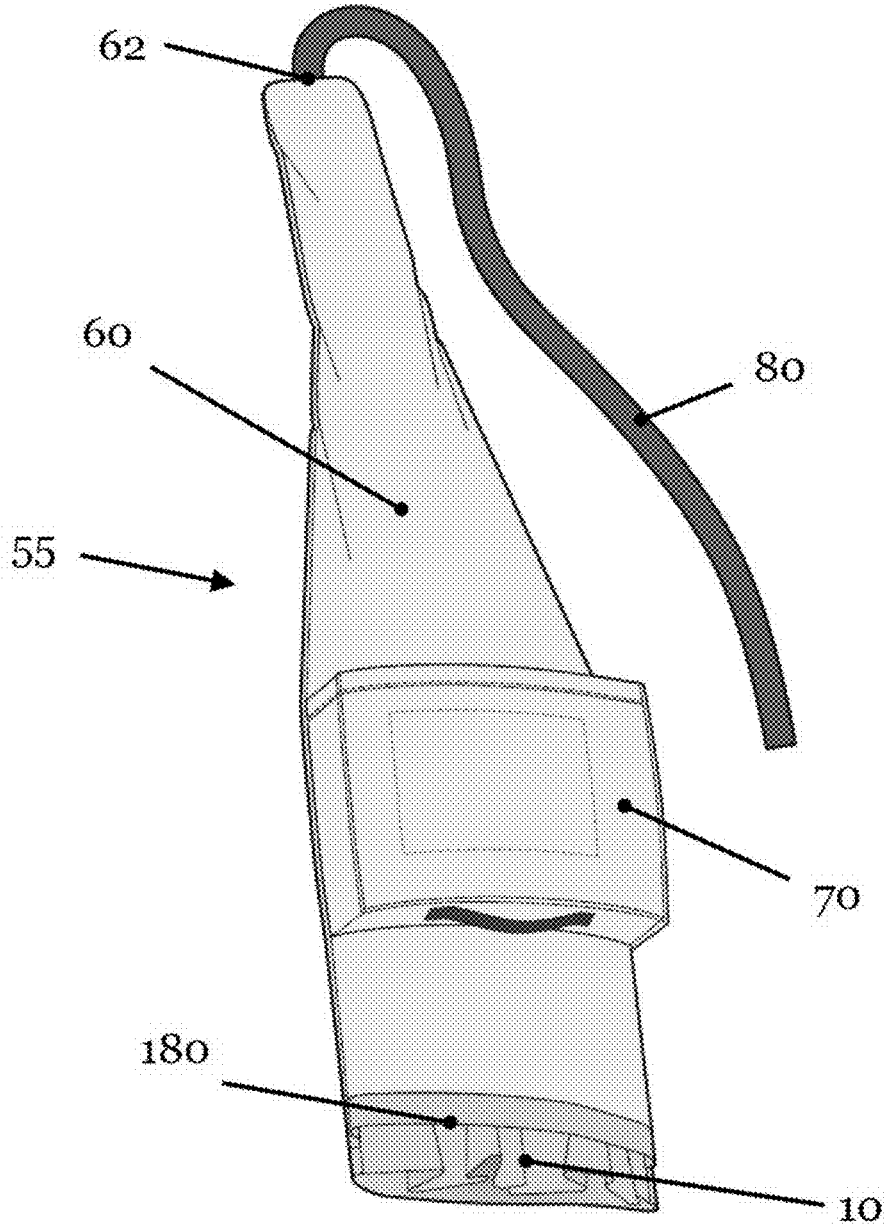
FIG. 4: a front view of a rain protection parka when the parka is packed into the first pocket according to embodiments of the present invention.

FIG. 4 depicts a front view of the parka 10 when it is packet inside the integrated first pocket 55 according to embodiments of the present invention. The first pocket 55, which is formed between the back panel 20 of the parka 10 and the inner lining ply 60, is depicted when it is everted while the parka 10 is inside the first pocket 55. In this configuration, the second pocket 70 is attached to the outer surface of the inner lining ply 60. Inside the second pocket 70 that is arranged in an inside-out configuration there may be a closing lid 130 and a buckle 150 as depicted in FIG. 2.

The pulling element 80—for example a webbing pull strap, a cord or a thin rope etc.—may be connected to the upper edge 62 of the first pocket 55 by a seam or an additional fixing element like a carabiner, hook or buckle etc. The fixing element 90 that may be attached to an end of the pulling element 80 may be connected to a second fixing element that may be attached to the outside of the everted first pocket 55 or the second pocket 70, thereby forming a carrying strap for the parka 10 that is packed inside the first pocket 55. In this way, the parka 10 can conveniently be carried on the back of a person while the pulling element 80 serves as a carrying strap slung across the chest of a person. In combination with the fast and simple folding process that is employed to pack the parka 10 inside the first pocket 55, this additional feature enables the person wearing the parka 10 to quickly remove, store and carry it as well as to quickly unpack it and to use it again if the need arises. This aspect of the present invention may be very useful for professional athletes such as trail runners and/or mountain bikers participating in a competition where the time needed for changing equipment has to be as short as possible and changing weather conditions prevail.

FIG. 4 also depicts an opening 180 of the first pocket that may be located at the bottom end of the first pocket 55 and may be downwardly directed. The edges of the opening 180 are formed by the lower edge of the pack panel 20 and the lower edge of the inner lining ply 60. This configuration allows to drain and remove moisture that may be covering the parka 10 when folded inside the first pocket 55. In this way, the parka 10 may become dry even when it is folded and carried on the back of a person.

Figure 5:
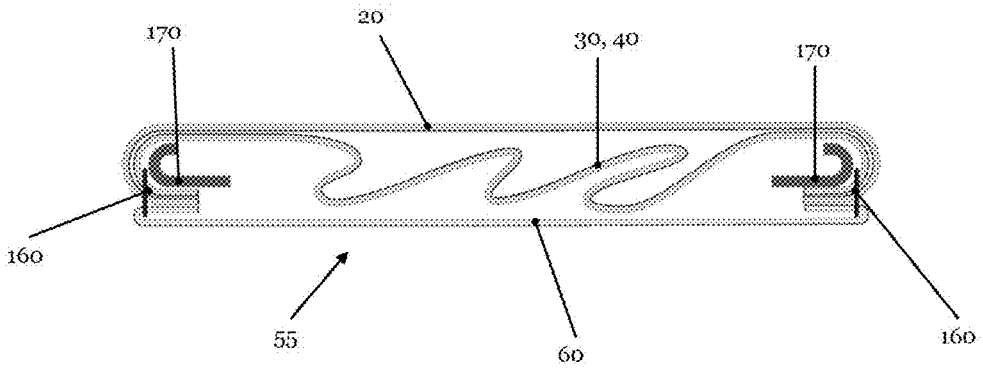
FIG. 5: a cross-sectional view of a rain protection parka when the parka is packed into the first pocket according to embodiments of the present invention.

FIG. 5 depicts a cross-section view through the parka 10 when it is packed inside the first pocket 55 as shown in FIG. 4 according to embodiments of the present invention. The back panel 20 and the inner lining ply 60 are connected via stitching seams 160 along their left and right edges that simultaneously connect the edges of the left front panel 40 and the right front panel 30 with the left and the right edge of the back panel 20. The stitching seams 160 may be reinforced by material strips 170.

Figure 6:
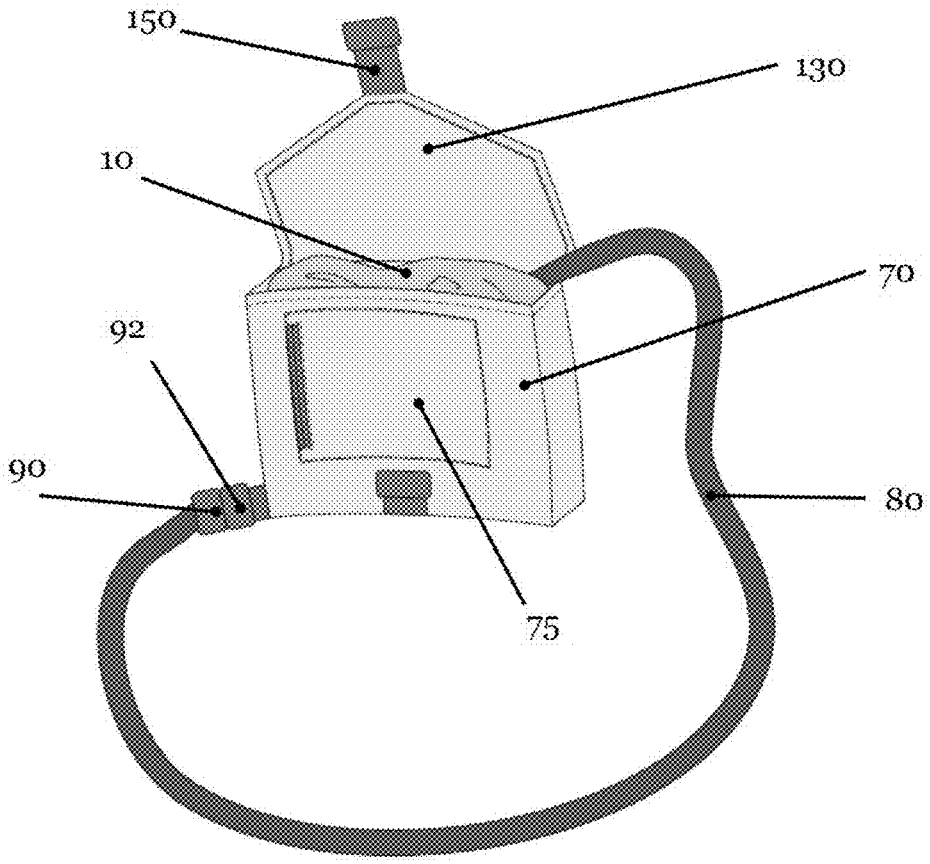
FIG. 6: a front view of a rain protection parka when the parka is stored inside the second pocket and the pulling element forms a carrying strap according to embodiments of the present invention.

FIG. 6 depicts a front view of the parka 10 when it is packed inside the second pocket 70 according to an embodiments of the present invention. The second pocket 70 may be closed by a lid 130 and a buckle 150 and may comprise an additional part of a buckle 92 that may interact with the corresponding part of a buckle 90 that may be connected to one end of the pulling element 80 thereby forming a carrying strap for the second pocket. The pulling element 80 may be also stored within the second pocket 70 thereby further reducing the volume of the parka 10 when not in use. The second pocket 70 allows to store the parka 10 at much lower volume than the first pocket. Additionally, the second pocket 70 may comprise at least a third pocket 75 attached to a surface of the second pocket 70 suitable for storing small items such as keys, money etc.

In some embodiments of the present invention the second pocket 70 may comprise a very light material and may neither comprise the additional buckle connector 92 nor the lid 130 nor the buckle 150. Thus, the weight of the parka 10 may be reduced and the appearance and wearing comfort may be improved when the parka 10 is in use.

In the following, exemplary embodiments of the present invention of a bag that may be packed into an integrated pocket is described in more detail. It is to be understood that the present invention is not limited to these specific embodiments but could be applied to any type of bag, for instance travel bags, sports bags, back packs etc. as well.

Figure 7:
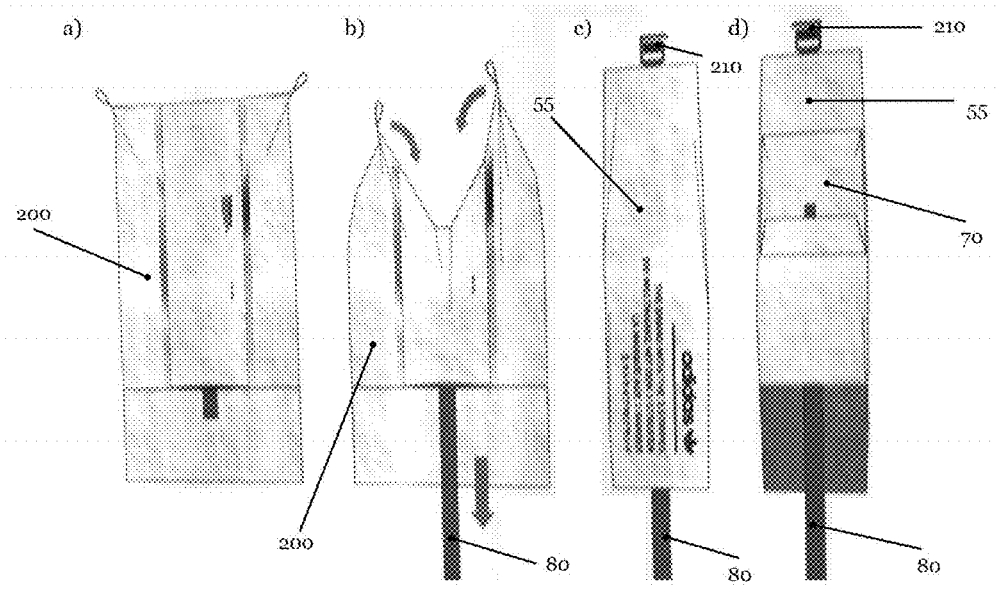
FIG. 7: four distinct views of a foldable bag illustrating the steps required to pack the bag into the first pocket.

FIG. 7 depicts four different views of a foldable bag 200 according to embodiments of the present invention. In FIG. 7 *a*) the bag 200 is depicted in an unfolded configuration, as it may be the case when in use. FIG. 7 *b*) depicts an intermediate step of the folding process that may be executed in order to pack the bag 200 into the first pocket 55. In this configuration, the pulling element 80, that is realized in these embodiments as a strap, has already been pulled to some extent. FIG. 7 *c*) depicts the bag 200 when it is inside the first pocket 55. The pulling element 80 may be connected to a fixing element 210 that is attached at the upper end of the first pocket 55, thereby forming a carrying strap for the first pocket 55

FIG. 7 *d*) depicts the same configuration as FIG. 7 *c*) rotated by 180°. In addition to the features that may be seen in FIG. 7 *d*) the second pocket 70 is depicted, into with the first pocket 55 may be packed, when the bag 200 is packed into the first pocket 55.

Figure 8:
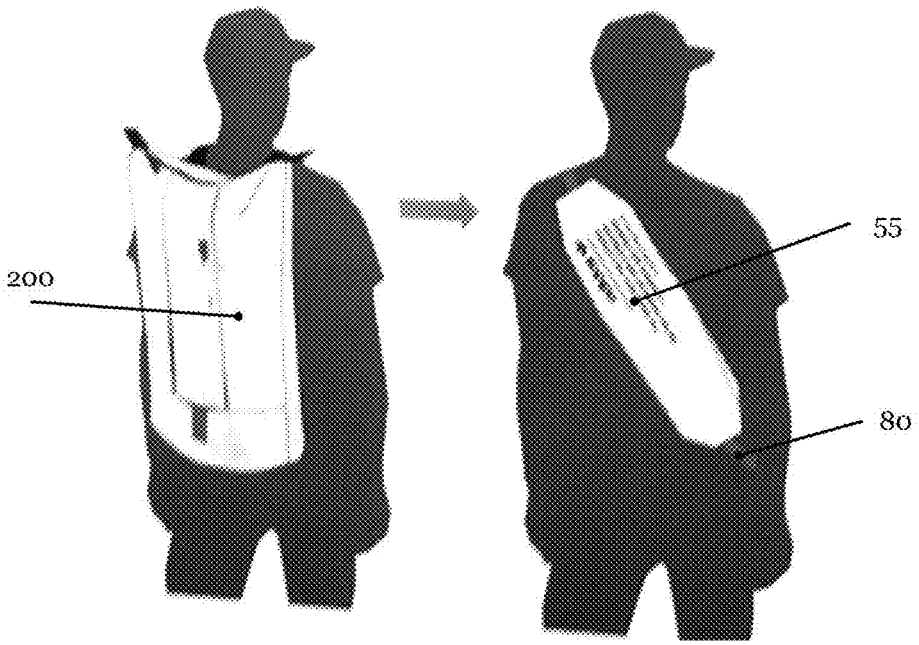
FIG. 8: a back view of a person wearing the bag when it is in use and when it is inside of the first pocket.

FIG. 8 depicts a back view of a person carrying the bag 200 in two different configurations. On the left part of FIG. 8 the person carries the bag 200 in an unfolded configuration, i.e. when the bag 200 is used to carry additional items that are stored inside the bag 200. The right part of FIG. 8 depicts the person carrying the bag when it is inside the first pocket 55.

The pulling element 80 is connected on two ends to the first pocket 55, thereby forming a carrying strap that is slung across the torso of the person.

In the following, further examples are described to facilitate the understanding of the invention:

1. Garment comprising: a. an integrated first pocket (55) into which the garment (10) may be packed, when not in use; b. wherein the first pocket (55) comprises an opening (180) arranged at the lower end of the garment (10).

2. Garment according to embodiment 1, wherein the opening (180) is downwardly directed.

3. Garment according to any of the preceding examples, wherein the opening (180) does not comprise a closure means.

4. Garment according to any of the preceding examples, wherein the first pocket (55) extends along a majority of the vertical extension of a back panel (20) of the garment (10).

5. Garment according to any of the preceding examples, wherein the first pocket (55) comprises a ply of material (60) sharing a seam with a seam interconnecting at least two panels of the garment (10).

6. Garment according to any of the preceding examples, wherein the first pocket (55) comprises a second pocket (70) into which the first pocket (55) may be packed, when the garment (10) is packed into the first pocket (55).

7. Garment comprising: a. an integrated first pocket (55) into which the garment (10) may be packed, when not in use; b. wherein the first pocket (55) extends along a majority of the vertical extension of a back panel (20) of the garment (10).

8. Garment comprising: a. an integrated first pocket (55) into which the garment (10) may be packed, when not in use; b. wherein the first pocket (55) comprises a second pocket (70) into which the first pocket (55) may be packed, when the garment (10) is packed into the first pocket (55).

9. Garment according to the preceding example, wherein the second pocket (70) is arranged inside the first pocket (55) when the garment (10) is in use.

10. Garment comprising: a. an integrated first pocket (55) into which the garment (10) may be packed, when not in use; b. wherein the first pocket (55) comprises a ply of material (60) sharing a seam with a seam interconnecting at least two panels of the garment.

11. Garment of any of the preceding examples, wherein the first pocket (55) further comprises a pulling element (80) adapted to cause a downward pull of the garment (10) into the first pocket (55).

12. Garment according to the previous example, wherein the pulling element (80) comprises a first fixing element (90) adapted to interact with a second fixing element attached to the first pocket (55) thereby forming a carrying strap for the first pocket (55).

13. Garment according to any of the preceding examples, wherein the garment (10) may be packed into the first pocket (55) by everting the first pocket (55) and/or the garment (10).

14. Garment according to any of the preceding examples, wherein the garment (10) is an upper body garment.

15. Bag comprising: a. an integrated first pocket (55) into which the bag (200) may be packed, when not in use; b. wherein the first pocket (55) comprises a second pocket (70) into which the first pocket (55) may be packed, when the bag (200) is packed into the first pocket (55).

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A garment comprising (a) a back panel and an inner lining;

(b) two sleeves configured for receiving respective arms of a wearer; and (c) an integrated first pocket into which a remainder of the garment is configured to be packed, when the remainder of the garment is not in use;

(d) wherein the first pocket comprises an opening arranged at a lower end of the garment, wherein the opening is downwardly directed, and wherein the opening does not comprise a closure means;

(e) wherein the first pocket is directly attached to the back panel and wherein the first pocket is directly attached to the inner lining; and (f) wherein the garment is a coat, a jacket, or a parka.

2. The garment according to claim 1, wherein the first pocket extends along a majority of a vertical extension of the back panel of the garment.

3. The garment according to claim 1, wherein the first pocket comprises a ply of material sharing one seam with a seam interconnecting at least two panels of the garment, wherein the at least two panels comprise:

(i) the back panel; and (ii) at least one of a left front panel, a right front panel and a head piece.

4. The garment according to claim 1, wherein the garment comprises a second pocket into which the first pocket is configured to be packed, when the remainder of the garment is packed into the first pocket.

5. The garment according to claim 4, wherein the second pocket is arranged inside the first pocket when the garment is in use.

6. The garment according to claim 5, wherein the second pocket has a smaller package volume than the first pocket.

7. The garment according to claim 6, wherein a first sleeve of the two sleeves is directly attached to a left front panel.

8. The garment according to claim 7, wherein a second sleeve of the two sleeves is directly attached to a right front panel.

9. The garment according to claim 6, wherein the garment further comprises a hood.

10. The garment according to claim 1, wherein the first pocket further comprises a pulling element adapted to pull the remainder of the garment into the first pocket.

11. The garment according claim 10, wherein the pulling element comprises a first fixing element adapted to interact with a second fixing element attached to the first pocket thereby forming a carrying strap for the first pocket.

12. The garment according to claim 1, wherein the remainder of the garment is packed into the first pocket by everting at least one of the first pocket or the remainder of the garment.

13. The garment according to claim 1, (g) wherein the opening defines at least a portion of a lowermost portion of the garment in a relaxed, upright configuration.

14. The garment according to claim 1, wherein the inner lining is formed from a different material than the back panel.

15. The garment according to claim 1, wherein the inner lining is formed from a same material as the back panel.

16. The garment according to claim 1, wherein the first pocket is directly attached to the back panel by sewing, gluing or welding.

17. The garment according to claim 1, wherein the first pocket is directly attached to the inner lining by sewing, gluing or welding.

18. The garment according to claim 1, wherein the first pocket is formed of a material that is waterproof and/or breathable.

* * * * *